US008806839B2

(12) United States Patent
Zhou et al.

(10) Patent No.: US 8,806,839 B2
(45) Date of Patent: Aug. 19, 2014

(54) CONCRETE MATERIAL AND METHOD FOR PREPARING THE SAME

(71) Applicants: Jialing Zhou, Shenzhen (CN); Zhiping Zhou, Shenzhen (CN); Benyuan Liu, Shenzhen (CN)

(72) Inventors: Jialing Zhou, Shenzhen (CN); Zhiping Zhou, Shenzhen (CN); Benyuan Liu, Shenzhen (CN)

( * ) Notice: Subject to any disclaimer, the term of this patent is extended or adjusted under 35 U.S.C. 154(b) by 0 days.

(21) Appl. No.: 13/759,010

(22) Filed: Feb. 4, 2013

(65) Prior Publication Data

US 2013/0145710 A1 Jun. 13, 2013

Related U.S. Application Data

(63) Continuation-in-part of application No. PCT/CN2010/077682, filed on Oct. 12, 2010.

(30) Foreign Application Priority Data

Aug. 12, 2010 (CN) ..... 2010 1 0252290

(51) Int. Cl.

| | |
|---|---|
| ***E04C 2/26*** | (2006.01) |
| ***B28B 23/02*** | (2006.01) |
| ***E04B 2/88*** | (2006.01) |
| ***B28B 23/00*** | (2006.01) |
| ***B28B 19/00*** | (2006.01) |
| *E04B 2/94* | (2006.01) |

(52) U.S. Cl.

CPC . *E04B 2/88* (2013.01); *B28B 23/02* (2013.01); *B28B 23/0075* (2013.01); *B28B 23/0056* (2013.01); *E04B 2/94* (2013.01); *E04C 2/26* (2013.01); *B28B 19/00* (2013.01)

USPC ..... 52/796.1; 52/742.14

(58) Field of Classification Search

CPC ..... E04B 1/665; E04B 2/8652; E04B 2/8641; E04F 13/0864; E04C 2/26; E04C 2/28; E04C 2/30; E04C 2002/04; E04C 2/044; E04C 2/045; B29L 2007/002; B28B 19/0092

USPC ..... 52/790.1, 796.12, 318, 396.05, 417, 52/441, 462, 742.14, 796.1

See application file for complete search history.

(56) References Cited

U.S. PATENT DOCUMENTS

| | | | | | |
|---|---|---|---|---|---|
| RE15,221 | E | * | 11/1921 | Megenity | 52/379 |
| 1,956,354 | A | * | 4/1934 | Junkers | 52/425 |
| 1,994,829 | A | * | 3/1935 | Nagin | 52/318 |

(Continued)

FOREIGN PATENT DOCUMENTS

| | | | | | |
|---|---|---|---|---|---|
| JP | 01039457 | A | * | 2/1989 | E04F 13/14 |
| WO | WO 2009087321 | A1 | * | 7/2009 | E04B 5/38 |

*Primary Examiner* — Christine T Cajilig

(74) *Attorney, Agent, or Firm* — Matthias Scholl P.C.; Matthias Scholl

(57) ABSTRACT

A combined concrete material, including: a concrete; a reinforcing bar, the reinforcing bar disposed inside the concrete; and a decorative sheet, the decorative sheet including: a flat part, a first junction, and a second junction. The concrete, the reinforcing bar, and the decorative sheet are fixed together as one whole body. The decorative sheet is disposed outside the concrete, and the inner surface of the flat part is attached to the outer surface of the concrete. The first junction and the second junction are disposed on two ends of the flat part. The inner surface of the flat part is concave and forms a dovetail slot. Neighboring decorative sheets are connected together via the first junction and the second junction, which are embedded in the concrete.

7 Claims, 4 Drawing Sheets

(56) References Cited

U.S. PATENT DOCUMENTS

| | | | | | |
|---|---|---|---|---|---|
| 2,031,007 | A | * | 2/1936 | Schulz | 52/181 |
| 2,078,281 | A | * | 4/1937 | Rowley et al. | 52/434 |
| 2,129,423 | A | * | 9/1938 | Hauch | 52/417 |
| 2,550,858 | A | * | 5/1951 | Parrett | 264/86 |
| 2,856,766 | A | * | 10/1958 | Huntley | 52/318 |
| 3,276,171 | A | * | 10/1966 | Brown | 52/86 |
| 3,284,980 | A | * | 11/1966 | Dinkel | 52/600 |
| 3,328,934 | A | * | 7/1967 | Hall | 52/597 |
| 3,353,313 | A | * | 11/1967 | Krysinski | 52/100 |
| 3,497,579 | A | * | 2/1970 | Barron | 264/33 |
| 3,592,435 | A | * | 7/1971 | Mattingly | 249/1 |
| 3,660,482 | A | * | 5/1972 | Elizalde | 52/537 |
| 3,754,066 | A | * | 8/1973 | Black | 264/71 |
| 3,969,861 | A | * | 7/1976 | O'Hanlon | 52/309.14 |
| 4,118,906 | A | * | 10/1978 | Preuninger et al. | 52/100 |
| 4,124,960 | A | * | 11/1978 | Bush et al. | 52/245 |
| 4,133,161 | A | * | 1/1979 | Lester | 52/748.1 |
| 4,355,453 | A | * | 10/1982 | Pause et al. | 29/460 |
| 4,551,961 | A | * | 11/1985 | Kiselewski | 52/742.14 |
| 5,168,682 | A | * | 12/1992 | Rye | 52/309.17 |
| 5,655,338 | A | * | 8/1997 | Lucas | 52/169.6 |
| 6,189,288 | B1 | * | 2/2001 | Bowers | 52/742.14 |
| 6,207,094 | B1 | * | 3/2001 | Farmer et al. | 264/219 |
| 8,033,070 | B2 | * | 10/2011 | Morello et al. | 52/462 |
| 2010/0242379 | A1 | * | 9/2010 | Norder et al. | 52/128 |
| 2011/0099927 | A1 | * | 5/2011 | Garcia Viar | 52/220.2 |
| 2011/0277410 | A1 | * | 11/2011 | Richardson et al. | 52/426 |

* cited by examiner

CONCRETE MATERIAL AND METHOD FOR PREPARING THE SAME

CROSS-REFERENCE TO RELATED APPLICATIONS

This application is a continuation-in-part of International Patent Application No. PCT/CN2010/077682 with an international filing date of Oct. 12, 2010, designating the United States, now pending, and further claims priority benefits to Chinese Patent Application No. 201010252290.0 filed Aug. 12, 2010. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 14781 Memorial Drive, Suite 1319, Houston, Tex. 77079.

BACKGROUND OF THE INVENTION

1. Field of the Invention

The invention relates to a field of constructive engineering technology, and more particularly to a combined concrete material and a method for preparing the same.

2. Description of the Related Art

A typical method for constructing a decorative curtain wall, for example an aluminum curtain wall or a stone curtain wall, includes fixing a steel skeleton on a concrete column or a concrete wall after completing the structural engineering, and then disposing decorative panels on the steel skeleton. On one hand, the method requires the fixation of the steel skeleton, thereby resulting in a high consumption of materials, high production cost, and complicated process; on the other hand, when the building reaches its service life, the outer wall needs to be evaluated, the decorative sheets are required to be removed, the process of which is complicated.

Currently, a fair-faced concrete is widely applied in civil engineering, such as, the bridge engineering and the urban overpass engineering. The fair-faced concrete is plain and simple, constructed by one step, and needs no repairing or rendering; thus, the construction waste is minimized, which is conducive to environmental protection. However, as the fair-faced concrete is disadvantageous in its monotone color and gap in the mold, the application of such a concrete is largely limited.

SUMMARY OF THE INVENTION

In view of the above-described problems, it is one objective of the invention to provide a combined concrete material that has a simple structure and a relatively low production cost.

It is another objective of the invention to provide a method for preparing the combined concrete material.

To achieve the above objective, in accordance with one embodiment of the invention, there is provided a combined concrete material comprising: a concrete; a reinforcing bar, the reinforcing bar being disposed inside the concrete; and a decorative sheet, the decorative sheet comprising: a flat part, a first junction, and a second junction. The concrete, the reinforcing bar, and the decorative sheet are fixed together as one whole body. The decorative sheet is disposed outside the concrete, and an inner surface of the flat part is attached to an outer surface of the concrete. The first junction and the second junction are disposed on two ends of the flat part. The inner surface of the flat part is concaved to form a dovetail slot. Neighboring decorative sheets are connected together via the first junction and the second junction. The first junction and the second junction are embedded in the concrete.

In a class of this embodiment, the first junction comprises: a first extended wall, and a first parallel wall. The first extended wall is formed by extending and inclining one end of the flat part backward; the first parallel wall is in parallel with the flat part and is formed by extending and inclining one end of the first extended wall backward.

In a class of this embodiment, the second junction comprises: a second extended wall, and a second parallel wall. The second extended wall is formed by extending and inclining the other end of the flat part backward; the second parallel wall is in parallel with the flat part and is formed by extending and inclining one end of the second extended wall backward. A vertical distance between the first parallel wall and the flat part is smaller than a vertical distance between the second parallel wall and the flat part.

In a class of this embodiment, the first parallel wall of one decorative sheet is disposed outside the second parallel wall of a neighboring decorative sheet. An auxiliary material is disposed between the first parallel wall and the second parallel wall for adhesion.

In a class of this embodiment, a gap is arranged between two neighboring flat parts of two neighboring decorative sheets. A filler is filled between the first extended wall and the second extended wall of the two neighboring decorative sheets.

In a class of this embodiment, a weather resistant adhesive or a decorative strip is disposed on a surface of the filler.

In a class of this embodiment, a connecting part is fixed on the inner side of the flat part; the connecting part is embedded inside the concrete; the connecting part comprises two splayed connecting pawls which are inclined and extended in an opposite direction far away from each other.

In a class of this embodiment, a plurality of the decorative sheets are fixed on the outer surface of the concrete. A recess is arranged on each end of the decorative sheet. The decorative sheet is fixed on the outer surface of the concrete via a connecting piece. The connecting piece comprises two ends, one end is disposed inside a space formed by two recesses of two neighboring decorative sheets, and the other end is inserted into the concrete.

In a class of this embodiment, the connecting piece comprises: a first fixing part, and a second fixing part. The first fixing part is disposed inside the recess and is in parallel with the decorative sheet. A cross section of the second fixing part is in a Y shape; one end of the second fixing part is perpendicular to the first fixing part, and the other end of the second fixing part is disposed inside the concrete.

In a class of this embodiment, an auxiliary material is disposed between the first fixing part and the second fixing part for adhesion.

In a class of this embodiment, the decorative sheet is made of stone or metal; and a strengthening mesh is attached to an inner side of the decorative sheet.

In a class of this embodiment, the strengthening mesh is a steel mesh or a plastic mesh.

In accordance with another embodiment of the invention, there provided is a method for preparing the combined concrete material. The method comprises the following steps: a) installing the decorative sheet and a mold, prefixing the decorative sheet, and attaching an outer surface of the decorative sheet to an inner surface of the mold; b) pouring the concrete into the mold; and c) removing the mold after coagulation of the concrete.

In a class of this embodiment, in step a), the decorative sheet is attached to the inner surface of the mold via a double sided adhesive tape.

In a class of this embodiment, in step a), the decorative sheet is prefixed on the reinforcing bar inside the mold via a fixing piece.

In a class of this embodiment, the method further comprises the following step between step a) and step b): disposing a pull rod between two neighboring decorative sheets, and fixing each end of the pull rod on the mold.

In a class of this embodiment, the method further comprises the following step after step b): removing two ends of the pull rod protruding from an inner surface and the outer surface of the concrete.

In a class of this embodiment, the pull rod comprises: an inner screw, and an outer screw. The inner screw crosses the concrete. An outer end of the inner screw comprises an internal thread. One end of the outer screw comprises an external thread matching with the internal thread of the inner screw; the outer screw is connected to the outer end of the inner screw. An inner end of the inner screw crosses the mold, and is fixed on the outside of the mold via a nut.

In a class of this embodiment, the decorative sheet is made of metal. The neighboring two decorative sheets are connected via the first connecting part and the second connecting part. The outer end of the inner screw of the pull rod is disposed on and limited by an outer side of the first connecting part.

Compared with prior arts, the combined concrete material of the invention comprises the concrete and the decorative sheet which are permanently connected together as one whole body. The decorative sheet prevents the concrete from the atmospheric corrosion, improves the durability of the concrete, and prolongs the service life of the building. The combined concrete material of the invention can achieve the same objective of the synchronous construction technology of the decoration and the structure, thereby directly saving the material consumption and manual labor, and lowering the production and maintenance cost. When the building reaches the service life, the combined concrete material can be directly evaluated, and the removal of the decorative sheet is not required. Not only does the combined concrete material of the invention have the advantages of the fair-face concrete such as one step formation, no repairing or rendering, reduced construction waste, and environmental protection, but also the combined concrete material is characterized in its decorative effect and structure stress, so that the structure and the culture are integrated as a whole. The invention provides a new kind of combined material that is economic, practical, and anti-corrosion, and provides a new technical scheme for improving the durability of the structure of the concrete and prolonging the service life of the building.

DETAILED DESCRIPTION OF THE EMBODIMENTS

To further illustrate the invention, experiments detailing a combined concrete material and a method for preparing the same are described below. It should be noted that the following examples are intended to describe and not to limit the invention.

Figure 1:
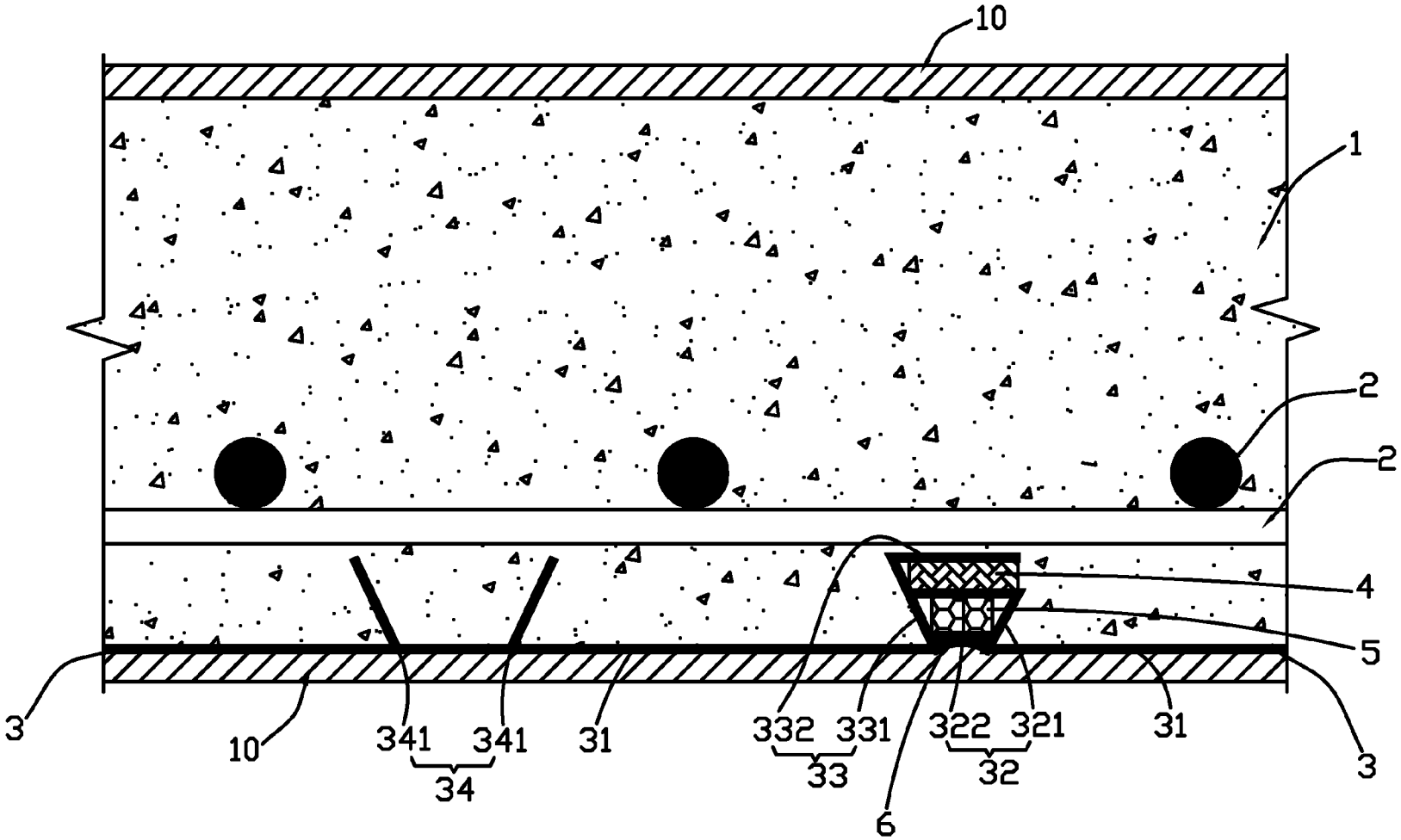
FIG. 1 is a cross sectional view of a combined concrete material in accordance with one embodiment of the invention.
Figure 2:
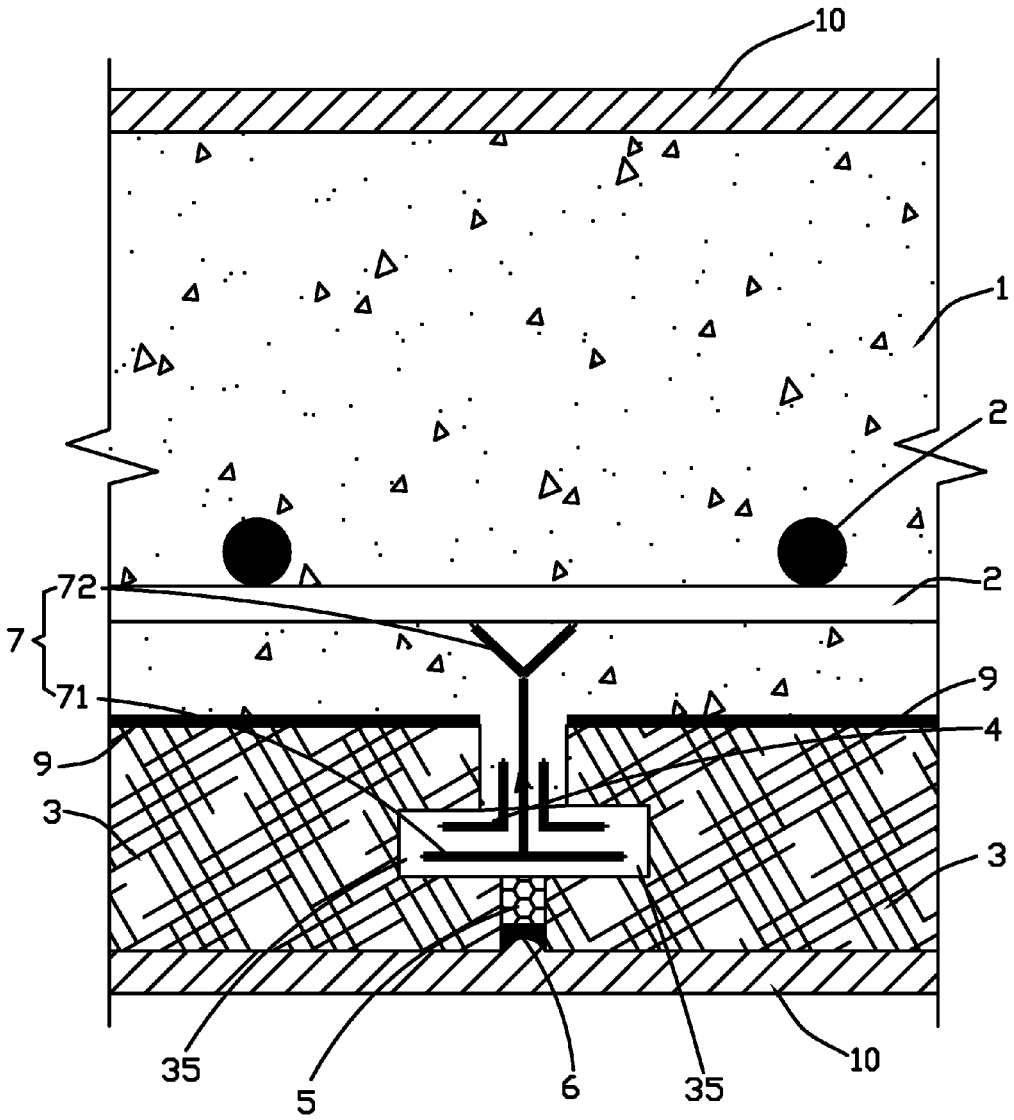
FIG. 2 is a cross sectional view of a combined concrete material in accordance with another embodiment of the invention.

As shown in FIGS. 1 and 2, a combined concrete material comprises: a concrete 1; a reinforcing bar 2 disposed inside the concrete; and a decorative sheet 3 disposed on an outer of the concrete 1. The concrete 1, the reinforcing bar 2, and the decorative sheet 3 are fixed together as one whole body. An inner surface of the decorative sheet 3 is attached to an outer surface of the concrete 1. The decorative sheet comprises: a flat part, a first junction, and a second junction. The flat part is disposed on the outer surface of the concrete. The first junction and the second junction are disposed on each end of the flat part. An inner surface of the flat part is concaved to form a dovetail slot 13. Neighboring decorative sheets are connected together via the first junction and the second junction. The first junction and the second junction are embedded in the concrete.

The concrete 1 comprises: cement, sand, stone, water, additive, and reinforcing bar. These ingredients are mixed according to a certain ratio and stirred by mechanical mode, poured into the mold, vibrated, and compacted within the preset time, and cured to form a solid. During the process, the flowability and the self-compaction of the concrete are intensified, besides the common characteristics of the fair-faced concrete, so that the quality of the pouring is improved. With the help of the current commercial concrete, the pumping concrete, the concrete distribution device, and the additive, the flowability, and the self-compaction of the concrete are largely improved.

The decorative sheet 3 is characterized in the concretive effect, intensity, durability, anti-aging, anti-corrosion, machining, and anti-fragmentation. The material of the decorative sheet 3 is aluminum alloy, stainless steel, copper, gold plated sheet, silver plated sheet, zinc plate, glass fiber reinforced plastics (FRP), new metal materials (such as metal glass and metal ceramic materials), weathering steel, aluminum alloy+polystyrene board+FRP combined material (thermal insulation material suitable for outer wall in cold regions), natural stone after processing, or combined materials thereof. A preferable material of the decorative sheet 3 is aluminum alloy which is solid, light, anti-corrosion, and anti-impact; besides, the aluminum alloy has different color, good processing ability, and low production cost. The size of each decorative sheet 3 is less than 3 m, a thickness of each sheet is determined according to the property of the material, the regional temperature, and the whole design, and is generally in the range of 3-250 mm.

As one example of a combined concrete material of the invention shown in FIG. 1, a plurality of the decorative sheet 3 is fixed on the outer surface of the concrete 1. The decorative sheet 3 is a metal plate. The decorative sheet 3 comprises: the flat part 31, the first junction 32, and the second junction 33. The flat part 31 is disposed on the outer surface of the concrete 1. The first junction 32 and the second junction 33 are disposed on each end of the flat part 31. The inner surface of the flat part 31 is concaved to form the dovetail slot 13. Neighboring decorative sheets 3 are connected together via the first junction 32 and the second junction 33. The first junction 32 and the second junction 33 are embedded in the concrete 1.

The first conjunction 32 is in a zigzag shape, and comprises: a first extended wall 321, and a first parallel wall 322. The first extended wall 321 is formed by extending and inclining one end of the flat part 31 backward; and the first parallel wall 321 is in parallel with the flat part 31 and is formed by extending and inclining one end of the first extended wall 321 backward.

The second junction 33 is in a zigzag shape, and comprises: a second extended wall 331, and a second parallel wall 332. The second extended wall 331 is formed by extending and inclining the other end of the flat part 31 backward; and the second parallel wall 332 is in parallel with the flat part and is formed by extending and inclining one end of the second extended wall 331 backward. A vertical distance between the first parallel wall 322 and the flat part 31 is smaller than a vertical distance between the second parallel wall 332 and the flat part 31.

Effective heights of the first junction 32 and the second junction 33 are vertical distances between the first parallel wall 322 and the flat part 31 and vertical distances between the second parallel wall 332 and the flat part 31, respectively. And the effective heights of first junction 32 and the second junction 33 are generally 1.5-3.5 mm.

The first parallel wall 322 of one decorative sheet 3 is disposed outside the second parallel wall 332 of the neighboring decorative sheet. An auxiliary material 4 that is adhesive, such as a double sided adhesive tape, is disposed between the first parallel wall 322 and the second parallel wall 332 for fixing and sealing the decorative sheet 3 and preventing the concrete 1 from leakage in the process of concrete pouring.

Two neighboring flat parts 31 of the decorative sheets 3 are in seamless connection; or a gap is arranged between two neighboring flat parts 31 of the decorative sheets 3. When the gap is formed between the two neighboring flat parts 31 of the decorative sheets 3, the gap is generally in the range of 15-60 mm. A filler 5 is filled between the first extended wall 321 and the second extended wall 331 of two neighboring decorative sheets 3, and a weather resistant adhesive 6 or a decorative strip is disposed on a surface of the filler 5. When the two neighboring flat parts 31 of the decorative sheets 3 are in seamless connection, the filler, the weather resistant adhesive, or the decorative strip is not needed.

To connect the decorative sheet 3 and the concrete 1 more compactly, a connecting part 34 is fixed on the inner side of the flat part 31. The connecting part 34 is embedded inside the concrete 1. The connecting part 34 comprises two splayed connecting pawls 341 which are inclined and extended in an opposite direction far away from each other. The material of the connecting pawl 341 is the same as that of the decorative sheet 3. The effective height of the connecting pawl 341, that is, a vertical distance between an outer end of the connecting pawl 341 and the flat part 31 of the decorative sheet 3, is in the range of 1.5-3.5 mm. The effective height is determined by the thickness of the protecting layer or the structure of the concrete 1. To form an intensified structure, the effective height of the connecting part 34 is increased to 100-300 mm, so that the connecting part 34 is inserted to the concrete 1 more deeply, and the properties of the combined concrete material are largely improved. The connecting part 34 is directly integrated on the decorative sheet 3 in the production by hot rolling formation, or the connecting part 34 is fixed on the inner side of the decorative sheet 3 by welding or riveting.

As another example of a combined concrete material of the invention shown in FIG. 2. The decorative sheet 3 is made of stone or metal. A recess 35 is arranged on each end of the decorative sheet 3. The decorative sheet 3 is fixed on the outer surface of the concrete 1 via a connecting piece 7. The connecting piece 7 comprises two ends, one end is disposed inside a space formed by two recesses 35 of two neighboring decorative sheets 3, and the other end is inserted into the concrete 1. The connecting piece 7 comprises: a first fixing part 71, and a second fixing part 72. The first fixing part 71 is disposed inside the recess 35 and is in parallel with the decorative sheet 3. A cross section of the second fixing part 72 is in a Y shape, one end of the second fixing part 72 is perpendicular to the first fixing part 71, and the other end of the second fixing part 72 is disposed inside the concrete 1.

An auxiliary material 4 that is adhesive, such as a double sided adhesive tape, is disposed between the first fixing part 71 and the second fixing part 72 for fixing and sealing the decorative sheet 3 and preventing the concrete 1 from leakage in the process of concrete pouring. A strengthening mesh 9 is attached to an inner side of the decorative sheet 3 for a permanent connection between the decorative sheet 3 and the concrete 1, as well as the intactness of the decorative sheet 3 during the construction process. The strengthening mesh 9 is a steel mesh or a plastic mesh.

A method for preparing the above combined concrete material, comprises the following steps:

a) installing the decorative sheet 3 and a mold 10, prefixing the decorative sheet 3, and attaching an outer surface of the decorative sheet 3 to an inner surface of the mold 10;

b) pouring the concrete 1 into the mold 10; and c) removing the mold 10 after coagulation of the concrete 1.

When the decorative sheet 3 is selected from light materials such as metal sheet, in step a), then the decorative sheet 1 is attached to the inner surface of the mold 10 via a double sided adhesive tape.

When the decorative sheet 3 is selected from heavy materials such as stone or metal sheet, then in step a), the decorative sheet 3 is prefixed on the reinforcing bar 2 inside the mold 10 via a fixing piece (not shown in the figures).

Figure 3:
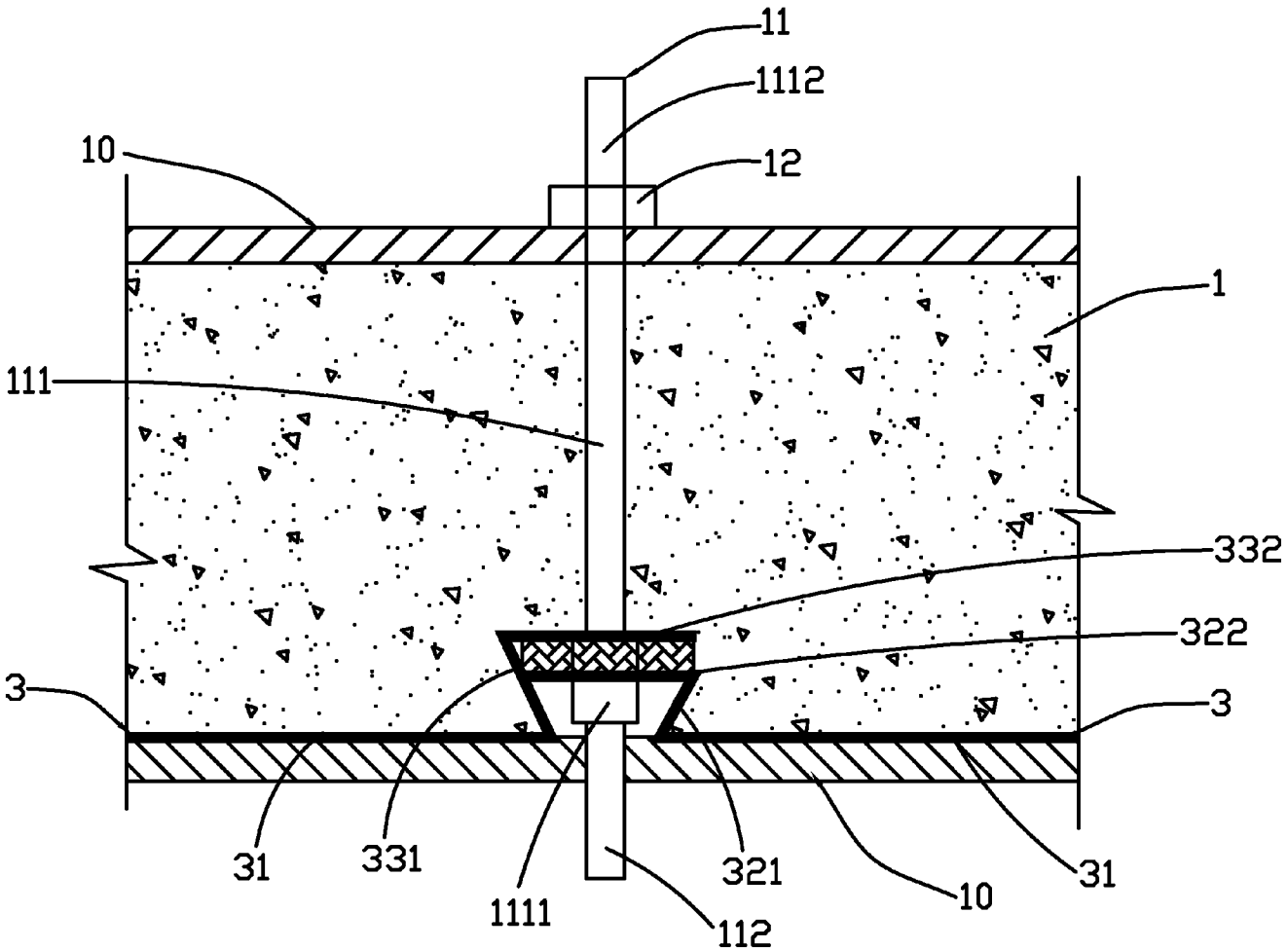
FIG. 3 is a cross sectional view of a combined concrete material in application in accordance with one embodiment of the invention.

In case of concrete 1 bloating, as shown in FIG. 3, the method further comprises the following step between step a) and step b): disposing a pull rod 11 between two neighboring decorative sheets 3, and fixing each end of the pull rod 11 on the mold 10 for fastening the mold 10. For a beautiful appearance, the method further comprises the following step after step b): removing two ends of the pull rod 11 protruding from an inner surface and the outer surface of the concrete 1.

The pull rod 11 comprises: an inner screw 111, and an outer screw 112. The inner screw 111 crosses the concrete 1. An outer end 1111 of the inner screw 111 comprises an internal thread. One end of the outer screw 112 comprises an external thread matching with the internal thread of the inner screw 111. The outer screw 112 is disposed on the outer end 1111 of the inner screw 111. An inner end 1112 of the inner screw 111 crosses the mold 10, and is fixed on the outside of the mold 10 via a nut 12. After the pouring of the concrete 1, it is very convenient to remove the inner screw 111 from the outer screw 112. When the decorative sheet is made of metal, as shown in FIG. 1, the neighboring two decorative sheets 3 are connected via the first junction 32 and the second junction 33; and the outer end 1111 of the inner screw 111 of the pull rod 11 is disposed on and limited by an outer side of the first junction 32.

Figure 4:
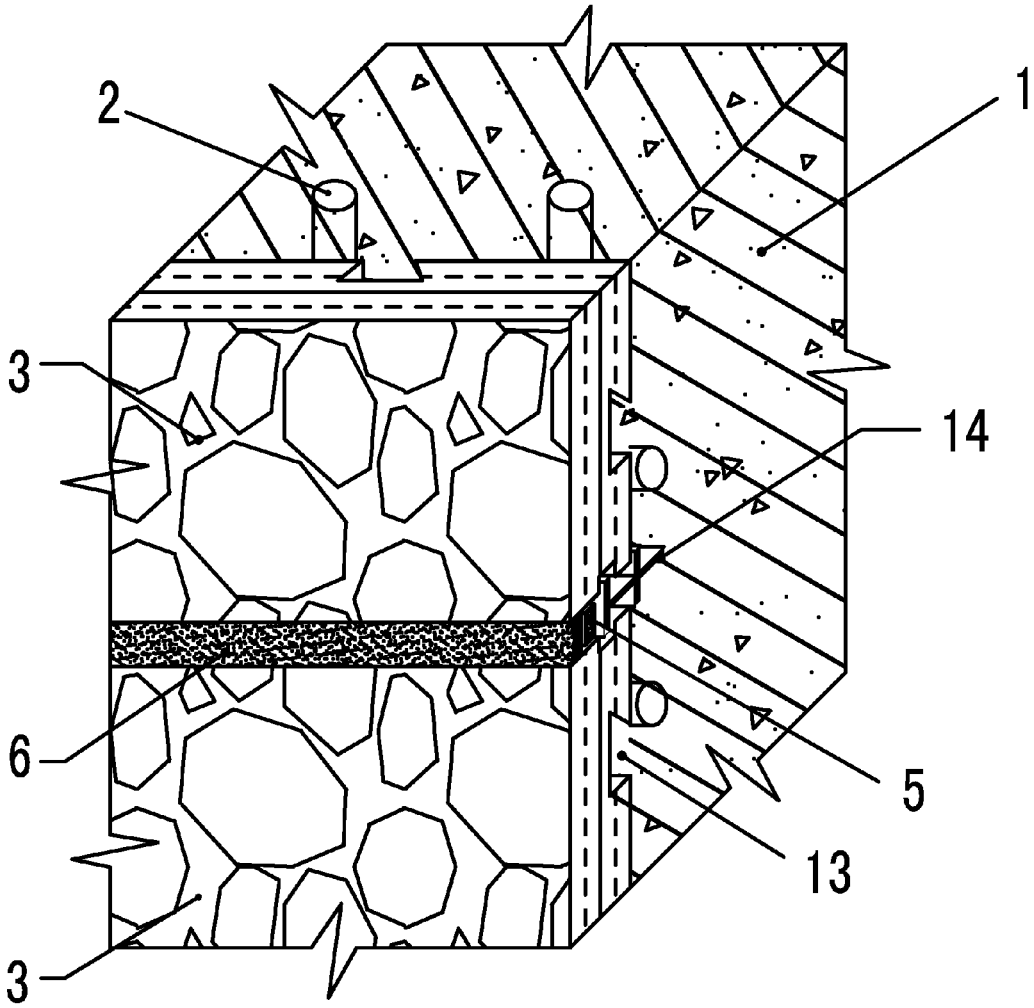
FIG. 4 is a stereogram of a combined concrete material in accordance with one embodiment of the invention.

In the process of installing the stone decorative sheet, an auxiliary piece 14 which is in a shape of a Chinese character "tu" is inserted to a slot arranged on an inner side of the stone (as shown in FIG. 4) to assure an suitable gap is formed between the neighboring stones, for fixation of the stones, and flatness of the neighboring stones, and to prevent leakage of the concrete.

The above combined concrete material comprises the concrete 1 and the decorative sheet 3 which are permanently connected together as one whole body. The decorative sheet 3 prevents the concrete 1 from the atmospheric corrosion, improves the durability of the concrete 1, and prolongs the service life of the building. The combined concrete material of the invention can achieve the same objective of the synchronous construction technology of the decoration and the structure, thereby directly saving the material consumption and manual labor, and lowering the production and maintenance cost. When the building reaches the service life, the combined concrete material can be directly identified, and the removal of the decorative sheet 3 is not required. Not only does the combined concrete material of the invention have the advantages of the fair-face concrete such as one step formation, no repairing or rendering, reduced construction waste, and environmental protection; but also the combined concrete material is characteristic in its decorative effect and structure stress, so that the structure and the culture are integrated as a whole. The invention provides a new kind of combined material that is economic, practical, and anti-corrosion, and provides a new technical scheme for improving the durability of the structure of the concrete 1 and prolonging the service life of the building.

The combined concrete material of the invention is mainly used in outer curtain wall which requires the synchronous construction of the decoration and the structure. The curtain wall comprises: metal sheet curtain wall, or stone curtain wall. The type of the curtain wall can be a single type, or a combination of several types.

In actual application, at first the type, color, size, and thickness of the decorative sheet 3 are chosen, and a design comprising the arrangement, size of the gap and the suture method are conducted, which is like the conventional deepening design of the steel structure, curtain wall engineering, and intelligent engineering. Thereafter, the raw materials are manufactured according to a design chart, the error of the decorative sheet 3 is controlled within one millimeter; and then in compliance with the method of the invention, the decorative sheet 3 and the mold are installed at the same time, during which the installation accuracy of the decorative sheet 3 is assured, and the mold 10 maintains the intensity of the decorative sheet 3. After the pouring of the concrete 1, the combined concrete material 1 is formed. The construction process is carried out with the help of the modern precision instrument and large construction machine, and the quality of the project meet the meet the national acceptance criteria.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A combined concrete material comprising:

a) a concrete, the concrete comprising an outer surface;

b) a reinforcing bar, the reinforcing bar disposed inside the concrete; and c) a decorative sheet, the decorative sheet comprising a flat part comprising an inner surface, a first junction, and a second junction; wherein:

the concrete, the reinforcing bar, and the decorative sheet are fixed together as one whole body;

the decorative sheet is disposed outside the concrete, and the inner surface of the flat part is attached to the outer surface of the concrete;

the first junction and the second junction are disposed on two ends of the flat part;

the inner surface of the flat part is concaved to form a dovetail slot;

neighboring decorative sheets are connected together via the first junction and the second junction;

the first junction and the second junction are embedded in the concrete;

the first junction comprises a first extended wall and a first parallel wall;

the first extended wall is formed by extending and inclining one end of the flat part backward;

the first parallel wall is in parallel with the flat part and is formed by extending and inclining one end of the first extended wall backward;

the second junction comprises a second extended wall and a second parallel wall;

the second extended wall is formed by extending and inclining the other end of the flat part backward;

the second parallel wall is in parallel with the flat part and is formed by extending and inclining one end of the second extended wall backward;

a vertical distance between the first parallel wall and the flat part is smaller than a vertical distance between the second parallel wall and the flat part;

a gap is arranged between two neighboring flat parts of two neighboring decorative sheets; and a filler is filled between the first extended wall and the second extended wall of the two neighboring decorative sheets.

2. The combined concrete material of claim 1, wherein the first parallel wall of one decorative sheet is disposed outside the second parallel wall of a neighboring decorative sheet; and an auxiliary material is disposed between the first parallel wall and the second parallel wall for adhesion.

3. The combined concrete material of claim 1, wherein a weather resistant adhesive or a decorative strip is disposed on a surface of the filler.

4. The combined concrete material of claim 3, wherein a connecting part is fixed on an inner side of the flat part; the connecting part is embedded inside the concrete; and the connecting part comprises two splayed connecting pawls which are inclined and extended in an opposite direction far away from each other.

5. A method for preparing a combined concrete material, the combined concrete material comprising:

a concrete, the concrete comprising an outer surface;

a reinforcing bar, the reinforcing bar disposed inside the concrete; and a decorative sheet, the decorative sheet comprising: a flat part comprising an inner surface, a first junction, and a second junction;

wherein:

the concrete, the reinforcing bar, and the decorative sheet are fixed together as one whole body;

the decorative sheet is disposed outside the concrete, and the inner surface of the flat part is attached to the outer surface of the concrete;

the first junction and the second junction are disposed on two ends of the flat part;

the inner surface of the flat part is concaved to form a dovetail slot;

neighboring decorative sheets are connected together via the first junction and the second junction; and the first junction and the second junction are embedded in the concrete; the method comprising:

a) installing the decorative sheet and a mold, prefixing the decorative sheet, and attaching an outer surface of the decorative sheet to an inner surface of the mold;

b) disposing a pull rod between two neighboring decorative sheets, and fixing each end of the pull rod on the mold;

c) pouring the concrete into the mold;

d) removing two ends of the pull rod protruding from an inner surface and the outer surface of the concrete; and e) removing the mold after coagulation of the concrete;

wherein:

the pull rod comprises: an inner screw, and an outer screw;

the inner screw crosses the concrete;

an outer end of the inner screw comprises an internal thread;

one end of the outer screw comprises an external thread matching with the internal thread of the inner screw;

the outer screw is connected to the outer end of the inner screw; and an inner end of the inner screw crosses the mold, and is fixed on the outside of the mold via a nut.

6. The method of claim 5, wherein in step a), the decorative sheet is attached to the inner surface of the mold via a double sided adhesive tape.

7. The method of claim 5, wherein the decorative sheet is made of metal;

the two neighboring decorative sheets are connected via the first junction and the second junction; and the outer end of the inner screw of the pull rod is disposed on and limited by an outer side of the first junction.

* * * * *